United States Patent [19]

Rubin

[11] Patent Number: 4,712,322

[45] Date of Patent: Dec. 15, 1987

[54] MULTIPLE MODULAR FRAME APPARATUS FOR DISPLAYING ITEMS

[75] Inventor: Gene L. Rubin, Mercer County, N.J.

[73] Assignee: Liberty Gifts, Inc., Trenton, N.J.

[21] Appl. No.: 887,814

[22] Filed: Jul. 21, 1986

[51] Int. Cl.[4] ..... G09F 1/12

[52] U.S. Cl. ..... 40/156; 40/152.1

[58] Field of Search ..... 40/152, 152.1, 156; 248/497

[56] References Cited

U.S. PATENT DOCUMENTS

| | | | |
|---|---|---|---|
| D. 142,501 | 10/1945 | Sherr | 29/20 |
| 1,067,792 | 7/1913 | Baron . | |
| 2,392,551 | 5/1943 | Roe | 72/38 |
| 2,758,402 | 8/1956 | Fulmer | 40/152.1 |
| 2,791,051 | 5/1957 | Scheyer | 40/152.1 |
| 3,339,302 | 9/1967 | Mallory | 40/152 |
| 3,471,959 | 10/1969 | Seger | 40/152 |
| 3,523,382 | 8/1970 | Dryer | 40/152 |
| 3,648,393 | 3/1972 | Parrilla | 40/152 |
| 4,115,938 | 9/1978 | Belmuth et al. | 40/152 |
| 4,510,707 | 4/1985 | Girard | 40/152 |
| 4,553,344 | 11/1985 | Rubin et al. | 40/152 |
| 4,608,770 | 9/1986 | Gray | 40/152.1 |

FOREIGN PATENT DOCUMENTS

| | | | |
|---|---|---|---|
| 4956/31 | 11/1931 | Australia | 52/311 |
| 12941 | 3/1944 | Czechoslovakia | 40/152 |
| 137862 | of 1903 | Fed. Rep. of Germany | 248/498 |
| 62281 | 1/1926 | Sweden | 37/6 |
| 2095990 | 10/1982 | United Kingdom | 40/152 |

*Primary Examiner*—Henry E. Raduazo

*Attorney, Agent, or Firm*—Alan M. Sack; Richard C. Woodbridge

[57] ABSTRACT

A multiple modular frame apparatus for displaying items includes a plurality of rhombus shaped frames having a circular aperture in at least one of the frames for viewing a display item. Each of the frames includes a dove tail groove which extends fully across each peripheral side. The multiple frame apparatus also includes an engagement means having two projections disposed approximately 180 degrees apart as viewed endwise. The projections are complementary to any two dove tail grooves of any two frames, respectively, for engaging any two frames by their dove tail grooves. Use of the dove tail grooves and the engagement means allow the frames to be assembled so that a number of the frames can completely surround a middle frame and the multiple modular frame apparatus can be assembled in an almost infinite number of aesthetically pleasing combinations. The apparatus lends itself especially to display photographs, or small collector plates which may be issued on a regular basis.

6 Claims, 18 Drawing Figures

FIG. 10

MULTIPLE MODULAR FRAME APPARATUS FOR DISPLAYING ITEMS

BACKGROUND OF THE INVENTION

1. Field of the Invention

This invention relates to a multiple modular frame apparatus for displaying items having a novel engagement means allowing the frames to be assembled in an almost indefinite number of aesthetically pleasing combinations.

2. Description of the Related Art

There are a number of devices known in the related arts which disclose a multiple frame apparatus for displaying items in an aperture. Typical devices are disclosed in U.S. Pat. Nos. 4,115,938; Des. 142,501; 3,471,959; 3,523,382; 3,339,309 and Swedish Pat. No. 62281. However, as far as understood, none of the related art teaches or suggests the use of a plurality of rhombus shaped frames for displaying items, each frame having a dove tail groove extending fully across each peripheral side. Nor does the related art teach or suggest an engagement means for engaging the dove tail grooves of any two adjacent frames to allow a number of frames to completely surround a middle frame, so that the multiple modular frame apparatus can be assembled in an almost infinite number aesthetically pleasing combinations. For example, U.S. Pat. No. 4,553,344 ("the '344 patent") issued to Rubin, et al., discloses a multiframe apparatus for displaying four subframes in an attractive grouping. The '344 patent discloses the preferred retaining means described herein. The '344 patent also discloses a groove and an engagement means on the sides of the subframes for holding the subframes in a main frame. However, the '344 patent does not teach or suggest the use of rhombus shaped frames having dove tail grooves extending fully across each peripheral side. Nor does the '344 patent teach how to join a plurality of subframes together independently of a main frame.

U.S. Pat. No. 3,648,393 ("the '393 patent") discloses a frame interconnecting member for connecting two rectangular picture frames. The frames have a dove tail groove on two adjacent sides. However, the frames also have one projection on at least one side of each frame. Therefore, the frames can only be connected in a much more limited number of combinations by the interconnecting member disclosed in the '393 patent then the unlimited number of combinations that the frames of the present invention can be connected. Also, the frames of the '393 patent cannot be joined in such a manner as to completely surround a central frame.

U.S. Pat. No. 2,392,551 ("the '551 patent") discloses interlocking building blocks for assembling a sturdy wall to serve as a wind break. The '551 patent discloses a key 20 which interlocks adjacent blocks having dove tail-shaped keyways 8—8 at opposite ends of the blocks. However, the '551 patent does not teach or suggest that any one may use this locking arrangement for constructing a multiple frame apparatus. Also, the keyways do not extend across all peripheral sides of the blocks, rather, they are disposed vertically to lock horizontally adjacent blocks together. The '551 patent uses other differently shaped mortise-tenum type projections and channels to lock vertically adjacent blocks together.

Another mortise-tenum system of interlocking building blocks is disclosed in U.S. Pat. No. 1,067,792 ("the '792 patent"). The '792 patent relates to the construction of foundations of buildings with columns having grooves on their sides and beams having projections which fit in the grooves. However, the grooves are not dove tail grooves, and the '792 patent neither teaches nor suggests how the structure disclosed therein could be applied to a multiple frame apparatus. Accordingly, the '792 patent does not appear to be any more relevant than those described above.

Accordingly, none of the prior art teaches or suggests the use of a plurality of rhombus shaped frames for displaying items, each frame having a dove tail groove extending fully across each peripheral side. Nor does the prior art teach or suggest an engagement means for engaging the dove tail groove of any two adjacent frames, to allow a number of frames to completely surround a middle frame, so that the multiple modular frame apparatus can be assembled in an infinite number of aesthetically pleasing combinations.

SUMMARY OF THE INVENTION

The present invention relates to a multiple modular frame apparatus for displaying items. It includes a plurality of rhombus shaped frames having a circular aperture in at least one of the frames for viewing a display item. Each of the frames includes a dove tail groove extending fully across each peripheral side. The frames are primarily used to display small collector plates, and the like, however, other items as could be displayed as well, including paintings, photographs, etc.

The present invention also includes a novel hanging means on at least one of the frames for hanging the multiple modular frame apparatus on a wall. Also, a retaining means is disclosed for retaining the display item within the circular aperture in the frame.

The multiple frame apparatus also includes an engagement means. The engagement means has two projections disposed approximately 180 degrees apart, as viewed endwise. The projections are complementary to any two dove tail grooves of any two frames, respectively, for engaging any two frames by their dove tail grooves. The dove tail grooves and the engagement means allow the frames to be assembled so that a number of frames can completely surround a middle frame and the multiple modular frame apparatus can be assembled in an infinite number of aesthetically pleasing combinations.

DETAILED DESCRIPTION OF THE PREFERRED EMBODIMENT

Figure 1A:
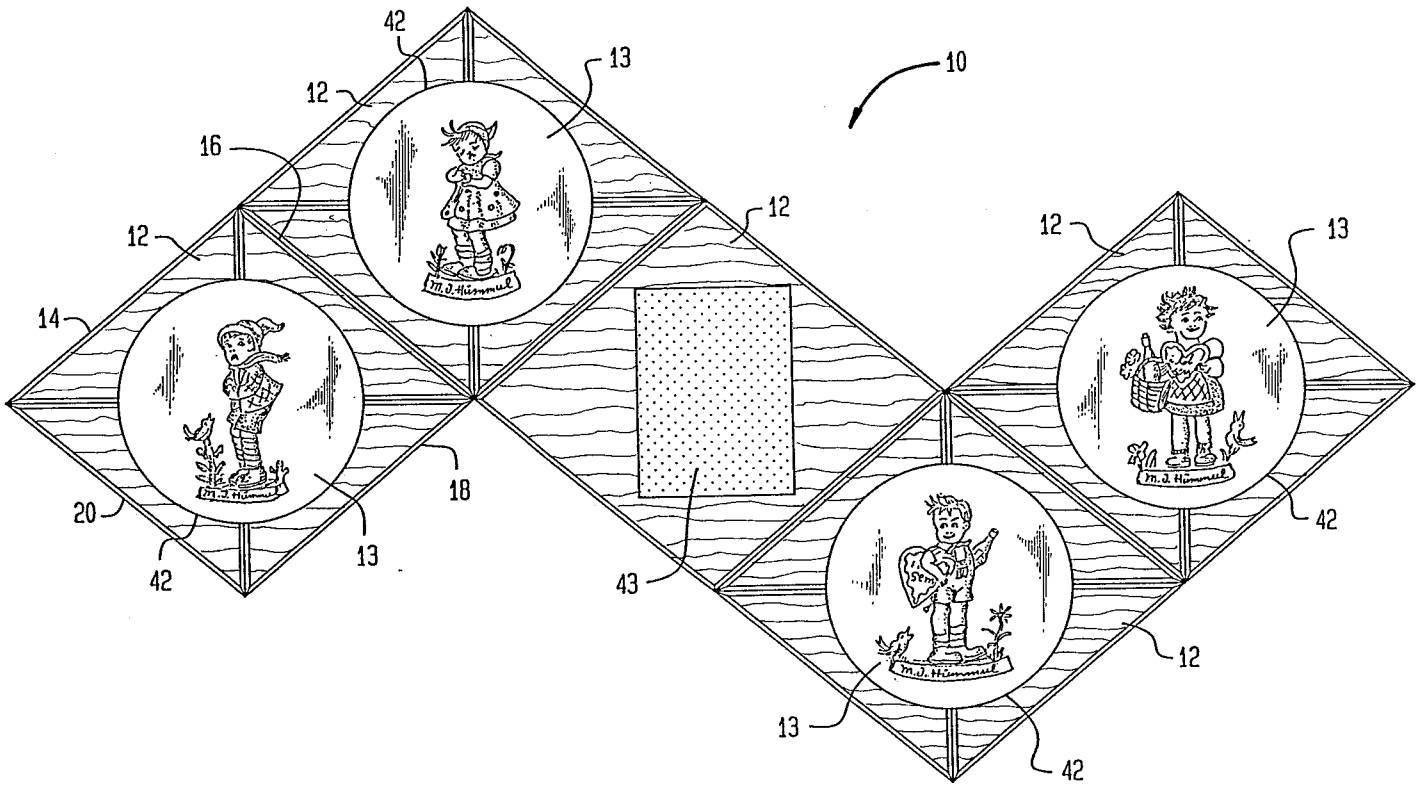
FIG. 1A is a front plan view of one representative preferred embodiment of the present invention.
Figure 1B:
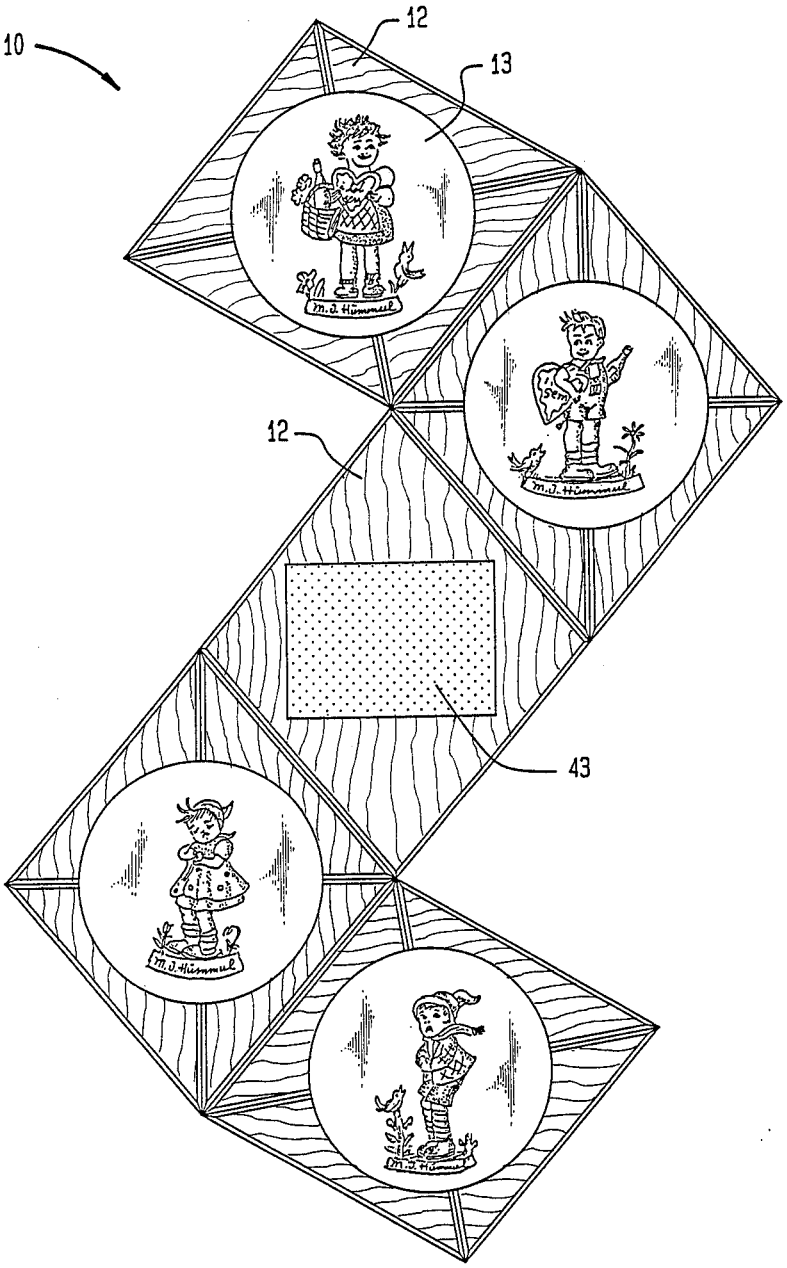
FIG. 1B is a variation of the preferred embodiment shown in FIG. 1A.
Figure 2A:
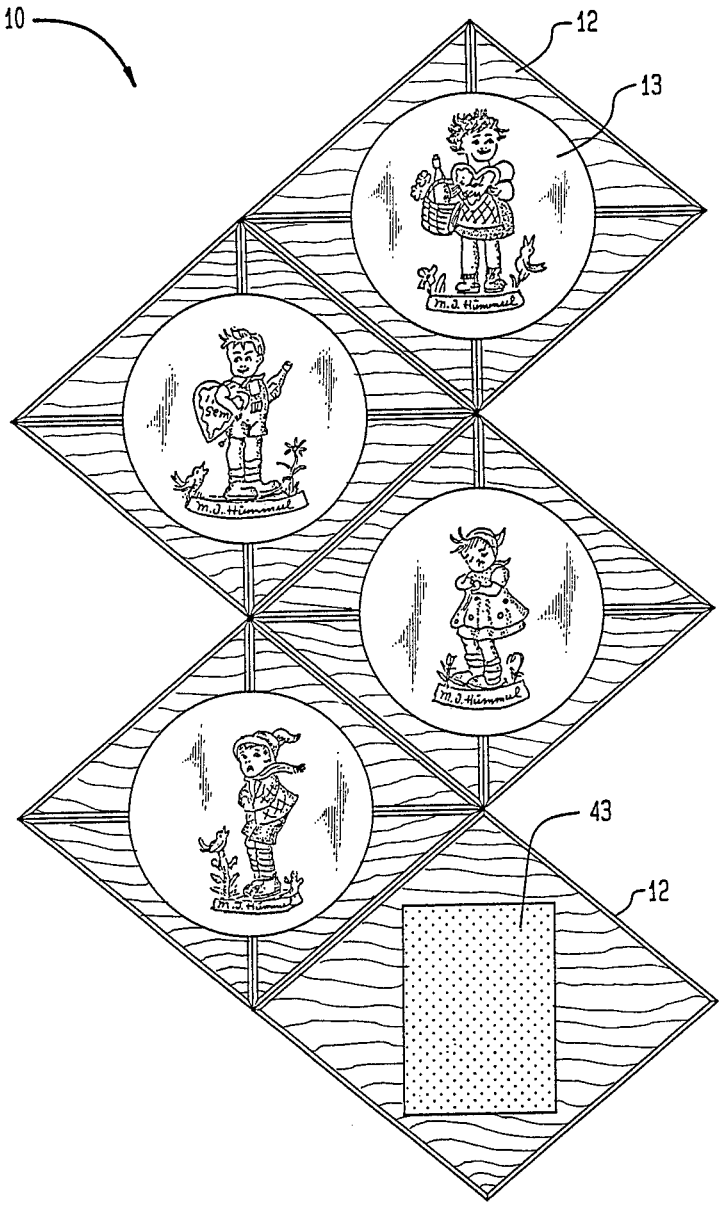
FIG. 2A is a front view of a second representative preferred embodiment of the present invention.
Figure 2B:
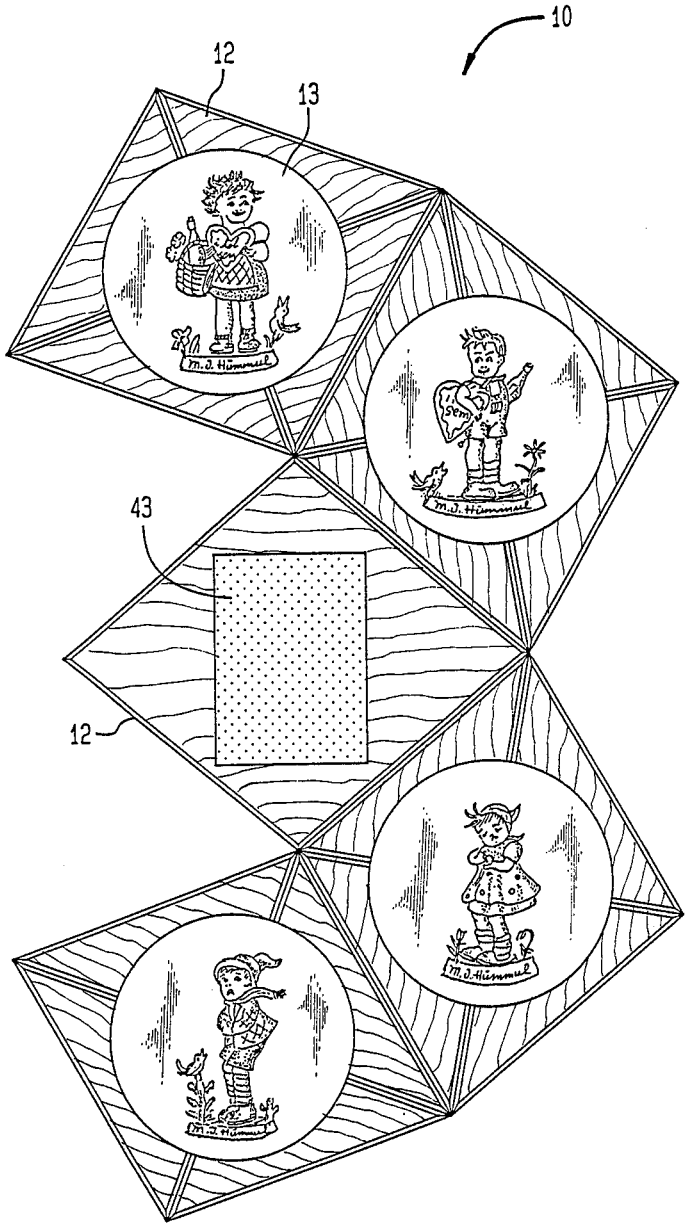
FIG. 2B is a variation of the preferred embodiment shown in FIG. 2A.
Figure 3A:
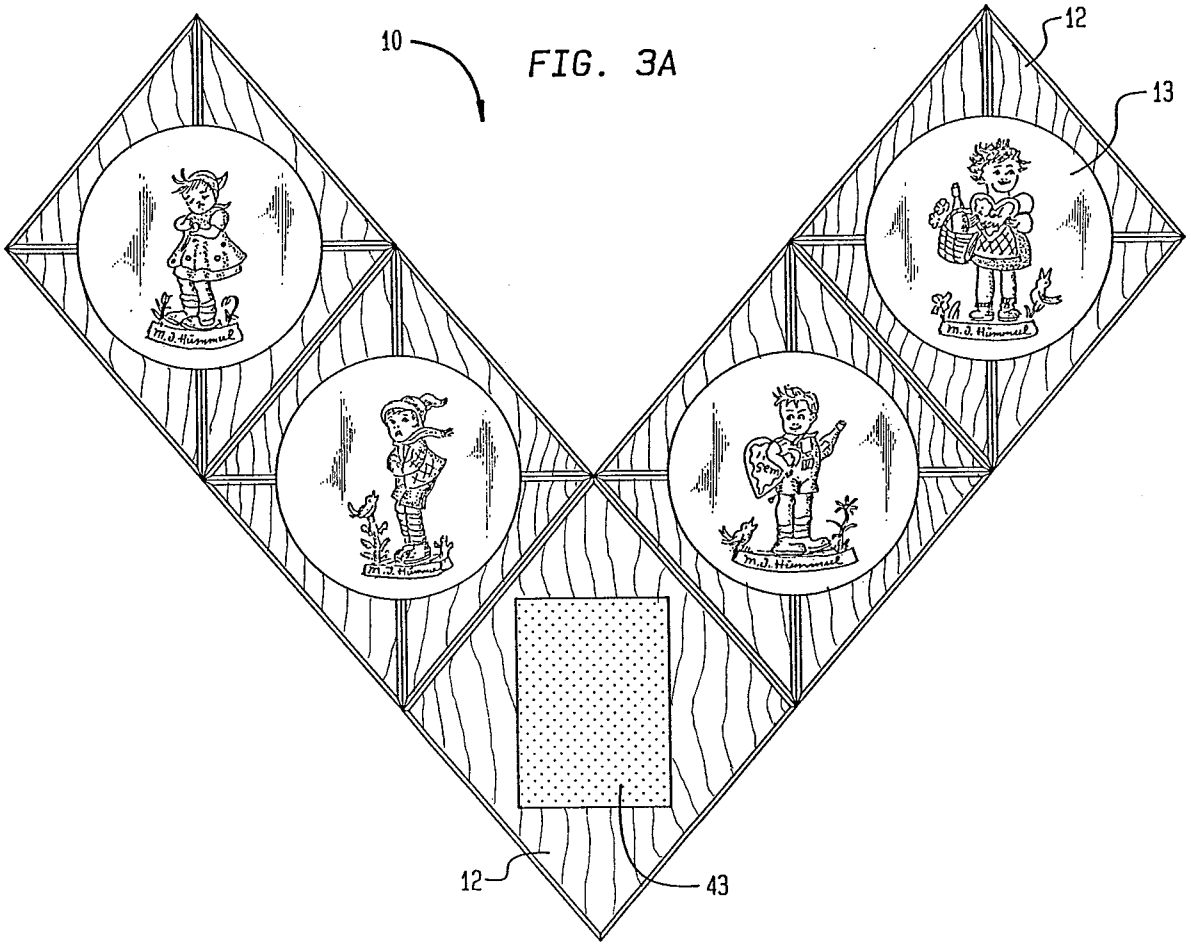
FIG. 3A is a front view of a third representative preferred embodiment of the present invention.
Figure 3B:
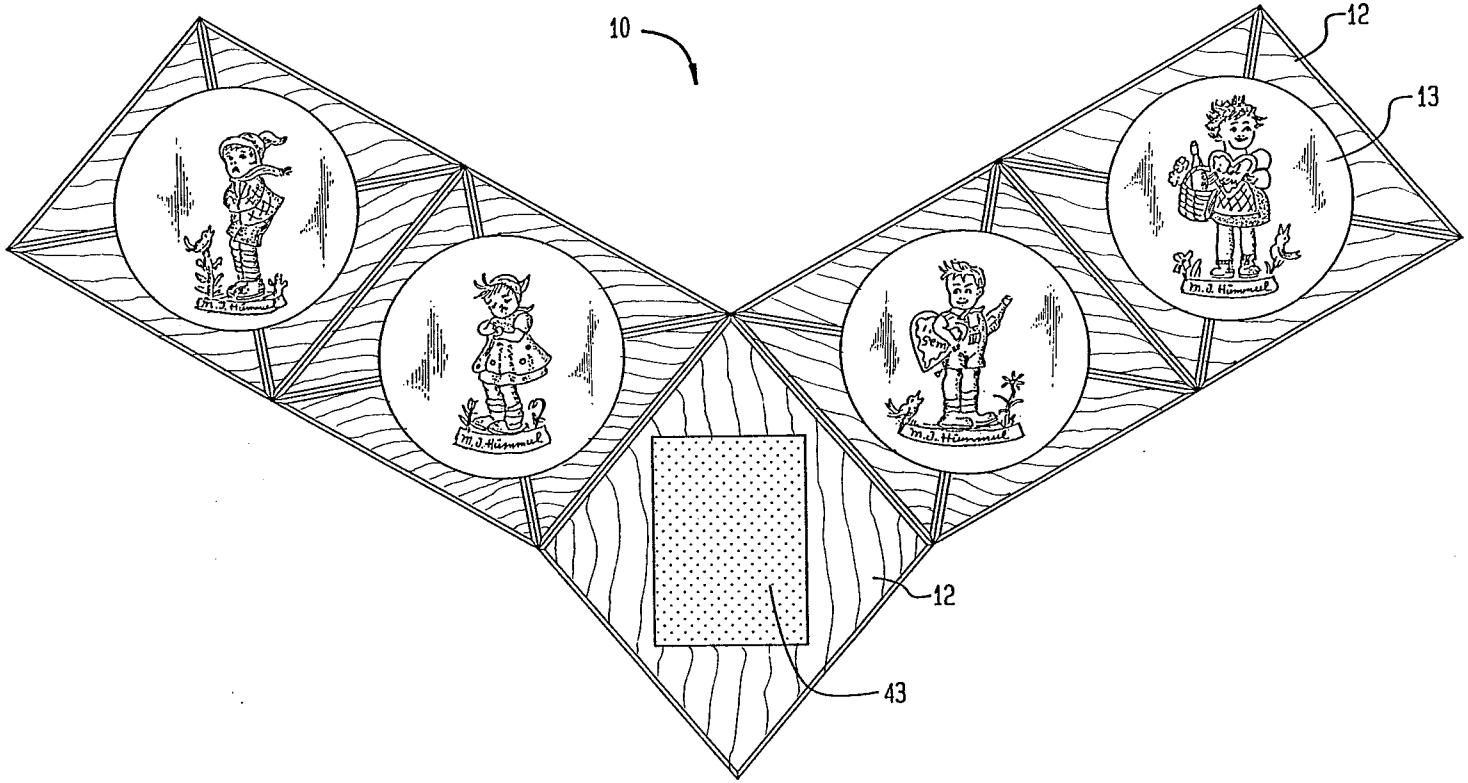
FIG. 3B is a variation of the preferred embodiment shown in FIG. 3A.
Figure 4:
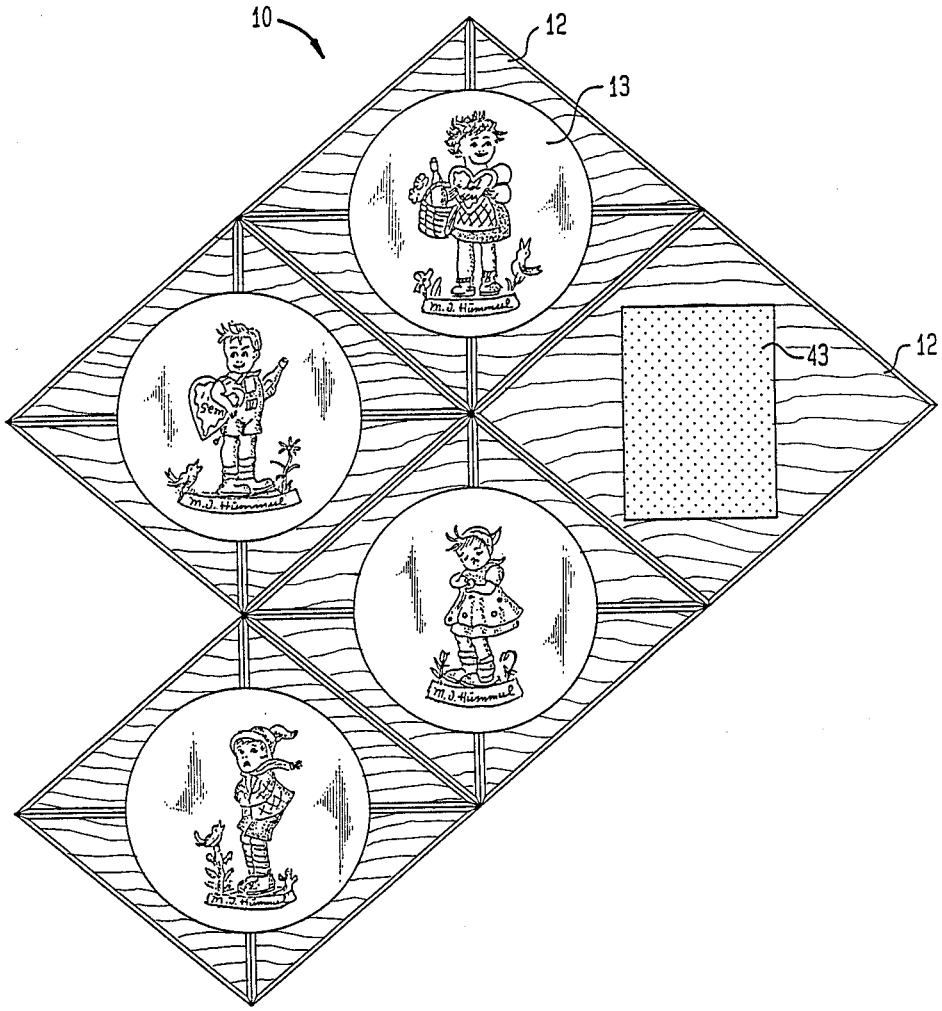
FIG. 4 is a front view of a fourth representative preferred embodiment of the present invention.
Figure 5:
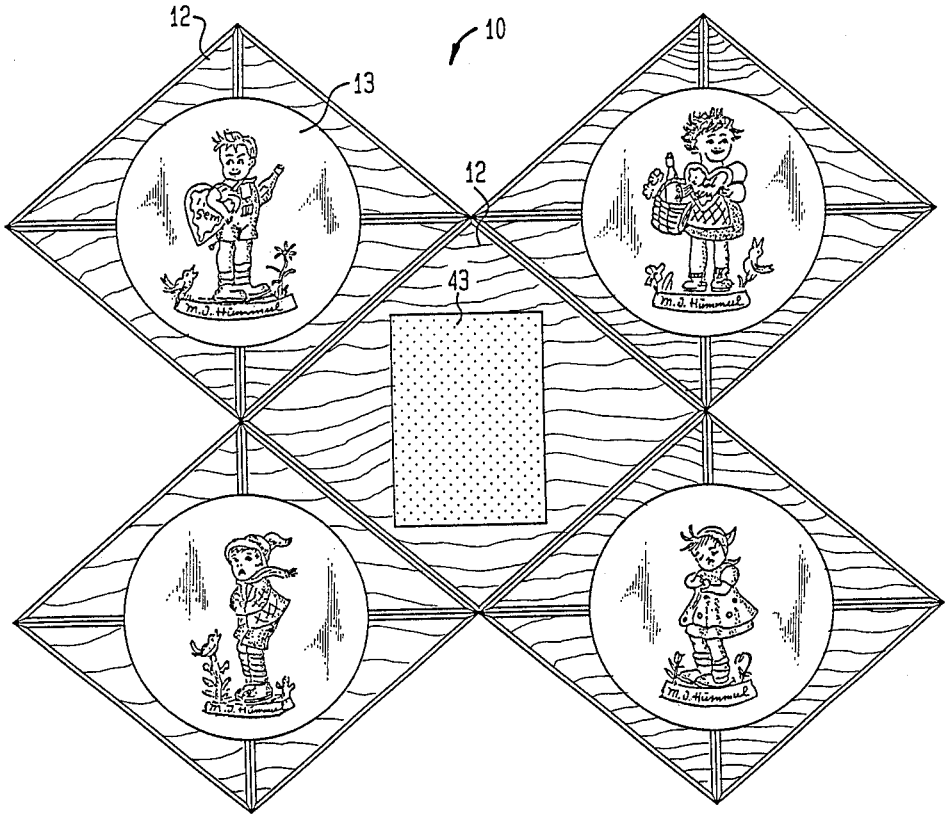
FIG. 5 is a front view of a fifth representative preferred embodiment of the present invention.
Figure 6B:
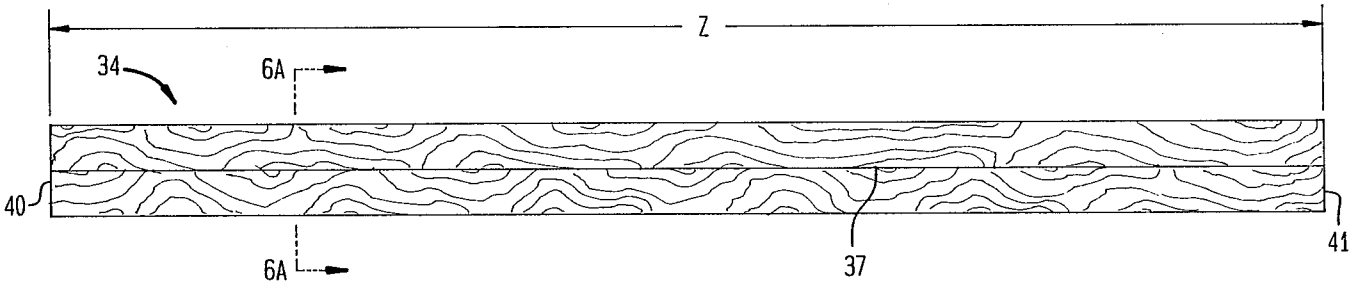
FIG. 6B is an elevational view of a wooden engagement means, viewed lengthwise.
Figure 6A:
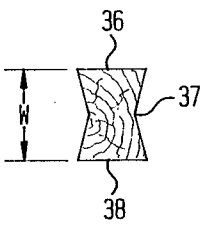
FIG. 6A is an elevational cross-sectional view of wooden engagement means viewed endwise along the line 6A—6A of FIG. 6B.
Figure 7B:
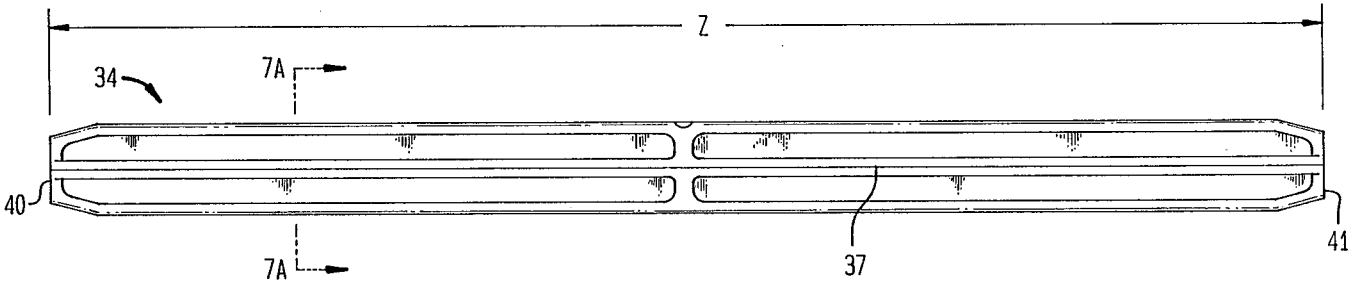
FIG. 7B is an elevational view of an injection molded engagement means, viewed lengthwise.
Figure 7A:
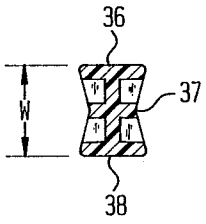
FIG. 7A is an elevational cross-sectional view of an injection molded engagement means viewed endwise along the line 7A—7A of FIG. 7B.

During the course of this description like numbers will be used to refer to like elements according to the different figures which illustrate the invention.

A multiple modular frame apparatus 10 according to a number of representative preferred embodiments are illustrated in FIGS. 1A–5. The multiple modular frame apparatus 10 includes a plurality of multi-sided frames 12 for displaying items 13. The frames 12 are primarily intended to display a small collector plate 13 such as the collector plates manufactured under the trademarks M. J. Hummel® or Goebel®. Collector plates 13 are frequently sold on an annual basis so that the apparatus 10 of the present invention can be expanded by the addition of more frames 12 as collector plates 13 are added. Likewise, other items may be displayed in the frames 12 of the apparatus 10 of the present invention, such as artwork, photographs and the like.

The frames 12, as illustrated in FIG. 8, may be parallelograms, which preferably are rhombus shaped. Each frame 12, has an interior angle X, which is the same as the corresponding interior angle X of every frame 12. Preferably, the interior angle X should be less than 90 degrees. In the preferred embodiments illustrated in FIGS. 1A–10 the interior angle X is approximately 80 degrees.

The frames 12 should preferably all have the same lengthwise dimension Y for each peripheral side 14, 16, 18 and 20, respectively. Each frames 12, includes groove means extending across each peripheral side 14, 16, 18 and 20, preferable the groove means is a dove tail groove 32.

Figure 10:
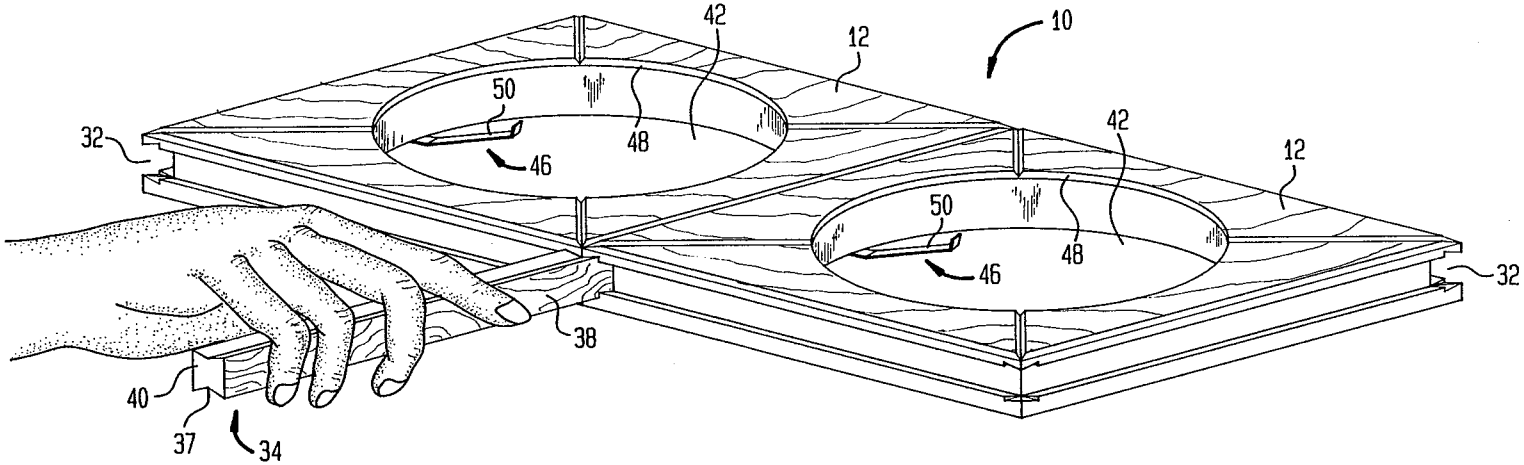
FIG. 10 is a perspective view of the present invention being assembled.

The multiple modular frame apparatus 10 also includes engagement means 34, illustrated in FIGS. 6A–7B, for engaging the groove means of the frames 12. Each engagement means has a first projection 36 and a second projection 38 for engaging at least two of the frames 12 by one of their grooves 32, respectively, as illustrated in FIG. 10. It is preferred that each of the projections 36 and 38, respectively, extend along an entire axial edge 37 of engagement means 34. In the preferred engagement means 34, projections 36 and 38 are disposed 180 degrees apart as viewed endwise, i.e., in direction of arrows 6A—6A or 7A—7A, towards either end 40 or 41 of engagement means 34. Preferably the axial length Z of engagement means 34 should not exceed the lengthwise dimension Y of each peripheral side 14, 16, 18, or 20 (−) minus the width W as viewed endwise of engagement means 34. As shown in FIG. 10, the projections 36 and 38, respectively, of engagement means 34 are complementary to any two grooves 32 for slidably engaging the grooves 32. The engagement means 34 and the groove 32 are designed to allow engagement means 34 to be slidably inserted into any two adjacent grooves 32 of two adjacent frames 12. Therefore, the corners of frames 12 have the unique geometry shown in FIGS. 8D and 10. Accordingly, the frames can be interconnected in a manner that allows a number of frames to completely surround a middle frame and the multiple modular frame apparatus 10 can be assembled in an infinite number of aesthetically pleasing combinations, some of which are shown in FIGS. 1A–5. In one embodiment shown in FIGS. 6A and 6B, engagement means 34 is manufactured from wood, and projections 36, 38 are dove tail projections. In another embodiment shown in FIGS. 7A and 7B engagement means 34 is injection molded from plastic, and projections 36 and 38 are "T" shaped.

The preferred multiple modular frame apparatus 10 of the present invention also includes an aperture 42 in at least one of the frames 12 for viewing a display item 14. In one preferred embodiment, shown in FIG. 8A, the aperture is circular. In the preferred embodiments illustrated in FIGS. 1A–5, at least one frame of the multiple frame apparatus 10 does not include an aperture, rather the frame includes a plaque 43. The frames that have apertures 42 each include a retaining means 46 for retaining the display item 13 in aperture 42. A preferred retaining means 46 includes a projection 48 on the interior of aperture 42 and a resilient clip 50, preferably made from a springy metallic material. The clip 50 is attached to the back of the frame 12 for securely holding the display item 13, such as the plates described above, against projection 48 in the frame 12.

Figure 8A:
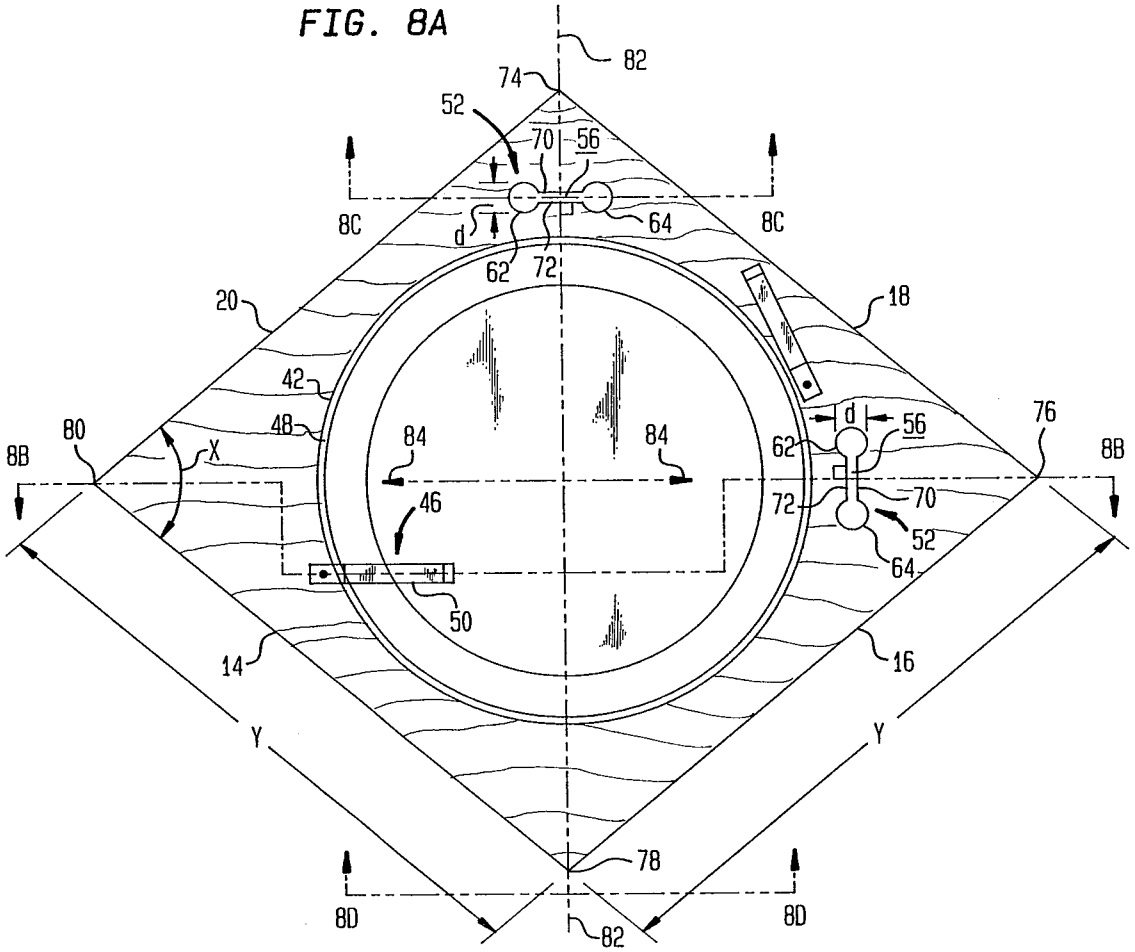
FIG. 8A is a rear plan view of a preferred frame of the present invention.
Figure 8B:
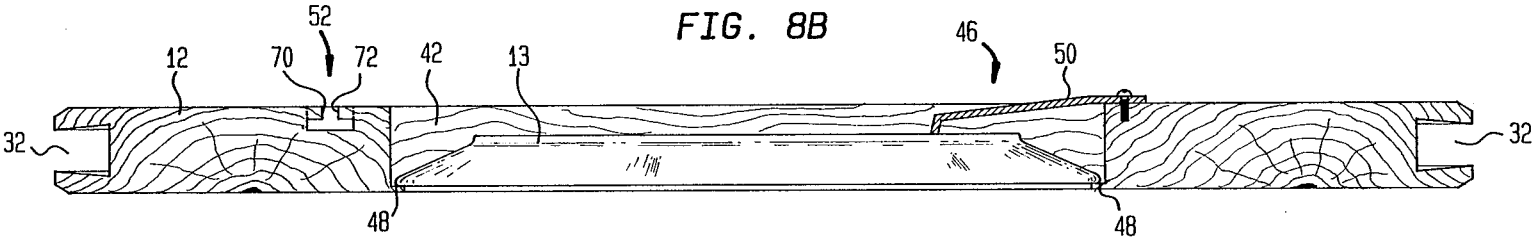
FIG. 8B is a detail cross-sectional view of the frame shown in FIG. 8A taken along the line 8B—8B.
Figure 8C:
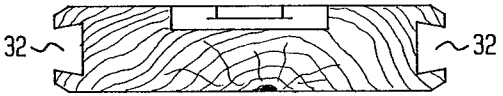
FIG. 8C is a cross-sectional view of a corner of the frame shown in FIG. 8A taken along the line 8C—8C.
Figure 8D:
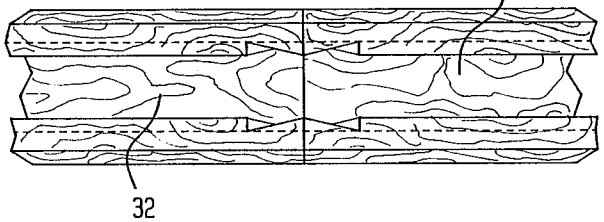
FIG. 8D is an elevational view of a corner of the frame shown in FIG. 8A taken along the line 8D—8D.
Figure 9:
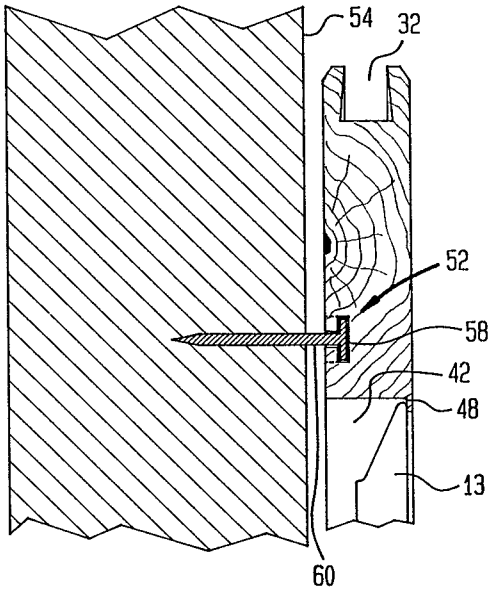
FIG. 9 is a partial cross-sectional view of a corner of the present invention hang on a wall.

The multiple modular frame apparatus 10 of the present invention includes a hanging means 52, as shown in FIGS. 8A through 9, on at least one of the frames 12 for hanging the multiple modular frame apparatus 10 on a wall 54. The hanging means 52 preferably includes a slot 56 in the back of the frame 12 for engaging with the head 58 of a nail-like projection 60. The slot 56 includes two circular entrances 62, 64. The circular entrances 62, 64 have a diameter d sufficient to allow entry of the head 58 of the nail-like projection 60. Opposing projections 70, 72 on the edges of the slot 56 are disposed between the two circular entrances 62, 64 for retaining the head 58 of the nail-like projection 60 in slidable contact between the two circular entrances 62, 64. It is also preferred, that the hanging means 52 is positioned on at least two adjacent corners 74, 76 of frame 12, and that slot 56 is positioned so it is perpendicular to and bisected by line 82—82 or 84—84 connecting any two opposite corners 74–78 or 76–80, respectively, of frame 12.

While the invention has been described with reference to the preferred embodiment thereof, it will be appreciated by those of ordinary skill in the art that various changes may be made to the structure, components and materials of the present invention without departing from its spirit and scope.

I claim:

1. A multiple modular frame apparatus comprising:

a. a plurality of multi-sided rhombus shaped frames for displaying items, wherein one interior angle of each of said frames is less than 90 degrees, said angle being the same as the corresponding interior angle of every one of said frames, and each peripheral side of each of said frames has the same lengthwise dimension;

b. groove means extending lenthwise fully across the peripheral sides of said frames, wherein said groove means is a dove-tail groove;

c. engagement means for engaging the groove means of said frames, wherein said engagement means includes a first and second projection means for engaging at least two of said frames by said groove means, said first and second projection are disposed 180 degrees apart as viewed endwise towards said engagement means, said projection means extending axialy along the entire edge of said engagement means, the axial length of said engagement means is not greater than the lengthwise dimension of said peripheral sides minus the width, as viewed endwise, of the engagement means, whereby the engagement means is complimentary to any two of said frames for slidably engaging said grove means of said frames so that said engagement means can be inserted into any of said grove means so that said frames can completely surround the middle frame;

d. a circular aperture in at least one of said frames for viewing a displayed item, wherein at least one of said frames does not include said circular aperture; and, e. a retaining means for retaining said items in said aperture of said frames, wherein said retaining means includes, (i) a projection on the interior of said circular aperture; and, (ii) a resilient clip attached to the back of said frame for holding said display item against the projection securely in said frame.

2. The apparatus of claim 1, wherein said frames further include a hanging means on at least one of said frames for hanging said frames on a wall; and said clip comprises a strip of springy metallic material.

3. The apparatus of claim 2, wherein said hanging means includes a slot in the back of said frame for engaging with the head of a nail-like projection.

4. The apparatus of claim 3, wherein said slot includes two circular entrances at two ends of said slot, the entrances having a diameter sufficient to allow entry of said head of said nail-like projection, said slot further includes opposing projections on the edges of the slot, the projections disposed between the two circular entrances for retaining the head of said nail-like projection in slidable contact between the circular entrances.

5. The apparatus of claim 4, wherein said hanging means is on at least two adjacent corners of said frame, and said indentation is perpendicular to and is bisected by a line connecting two opposite corners of said frame.

6. The apparatus of claim 5, wherein said one interior angle is approximately 80 degrees.

* * * * *